US006623532B2

(12) United States Patent
Nakamura et al.

(10) Patent No.: US 6,623,532 B2
(45) Date of Patent: Sep. 23, 2003

(54) INK-JET PRINTING METHOD AND PRINTED GOODS

(75) Inventors: Shungaku Nakamura, Fukui (JP); Ayumi Yamazaki, Fukui (JP)

(73) Assignee: Seiren Co., Ltd., Fukui (JP)

( * ) Notice: Subject to any disclaimer, the term of this patent is extended or adjusted under 35 U.S.C. 154(b) by 72 days.

(21) Appl. No.: 09/946,696

(22) Filed: Sep. 5, 2001

(65) Prior Publication Data

US 2002/0025379 A1 Feb. 28, 2002

(30) Foreign Application Priority Data

Sep. 6, 2000 (JP) ..... 2000-270620

(51) Int. Cl.[7] ..... D06P 3/82; D06P 3/872

(52) U.S. Cl. ..... 8/445; 8/532; 8/582; 8/586; 8/595; 8/617; 8/930; 8/543; 8/552; 8/445; 8/499; 8/495

(58) Field of Search ..... 8/495, 445, 532, 8/930, 586, 582, 552, 617, 595, 543

(56) References Cited

U.S. PATENT DOCUMENTS 4,767,420 A * 9/1988 Mehl et al.
5,498,267 A * 3/1996 Russ et al.
5,820,661 A * 10/1998 Gregory et al.

* cited by examiner

*Primary Examiner*—Margaret Einsmann
(74) *Attorney, Agent, or Firm*—Dilworth & Barrese, LLP

(57) ABSTRACT

The present invention provides a method of applying ink containing dyes to fabric composed of synthetic and cellulose fibers using an ink-jet system to print the fabric with high color shade depth and brilliancy and ink-jet printed goods obtained by the ink-jet printing method.

The fabric composed of cellulose and synthetic fibers is treated with an acidic aqueous dispersion containing cellulose reactive compound, water-soluble polymer and non-water-soluble inactive organic compound with a melting point of 40° C.-150° C. and the fabric is dried before its ink-jet printing with reactive and disperse dyes.

4 Claims, No Drawings

INK-JET PRINTING METHOD AND PRINTED GOODS

FIELD OF THE INVENTION

The present invention relates to a method of ink-jet printing fabric composed of synthetic and cellulose fibers and ink-jet printed goods obtained by the ink-jet printing method.

BACKGROUND OF THE INVENTION

Certain techniques are known for allowing fabric composed of polyester and cellulose fibers to be generally dyed with good color fastness by using disperse and reactive dyes. In the meantime, it is already known as prior art that polyester fiber fabric can be generally dyed with disperse dyes using an ink-jet system by treating the fabric with an acidic solution before its ink-jet dyeing.

According to the prior art, a similar ink-jet dyeing system is also applied to cellulose fiber fabric, provided that the fabric is treated with an alkaline solution before its ink-jet dyeing.

However, the application of this prior art system to fabric composed of synthetic and cellulose fibers presents a problem; if the fabric is treated with an alkaline solution before its ink-jet dyeing with more consideration given to the reactive dyes in the ink for its cellulose component, the disperse dyes in the ink for its synthetic component become unstable on it due to its alkalinity, resulting in difficulty in allowing it to be dyed with good reproducibility of its coloration.

If, conversely, the fabric is treated with an acidic solution before its ink-jet dyeing with more consideration given to the disperse dyes in the ink for its synthetic component, the reactive dyes in the ink applied to it are adversely affected by its acidity with deterioration in their affinity for its cellulose component, resulting in difficulty in providing it with a satisfactory color shade depth.

In order to solve the above-mentioned problem, studies have been conducted on the feasibility of ink-jet dyeing such fabric in two processes, although it has not yet been put to practical application because of it involves problems such as high cost and poor reproducibility.

As another approach toward the solution of this problem, researches have been undertaken for the development of alkali-resistant disperse dyes and reactive dyes capable of dyeing cellulose fiber in an acidic pH range, although none of such dyes currently available are satisfactory in their color shade depth and brilliancy.

As specific examples of the above-mentioned approach, Japanese Patent JP-A-56-4784 has disclosed a method of dyeing cellulose fiber fabric using a dye containing one or more S-triazinyl groups with a quaternary nitrogen substituent, eliminating the need for use of an acid binding agent.

As another such example, Published Japanese Patent Application JP-A-58-186682 discloses a method of dyeing cellulose fiber fabric using a dye containing one or more S-triazinyl groups with nicotinic acid in a pH range from weakly acidic to alkaline.

Similarly, JP-A-5-209375 discloses a method of dyeing cellulose fiber fabric using a dye containing one or more S-triazinyl groups with a pyridine derivative in a pH range from weakly acidic to neutral.

All of these methods are based on the use of a reactive dye containing a triazinyl group with a substituent introduced into it to accomplish dyeing of cellulose fiber by conventional printing and exhaustion dyeing methods.

However, the mere application of any such method to ink-jet printing of fabric composed of synthetic and cellulose fibers has been confirmed to result in failure to print it with satisfactory color shade depth, brilliancy and uniformity.

OBJECT OF THE INVENTION

It is therefore an object of the present invention to solve the above-mentioned problems of the prior art and thus to provide a method of applying ink containing dyes to fabric composed of synthetic and cellulose fibers using an ink-jet system to print the fabric with high color shade depth and brilliancy and ink-jet printed goods obtained by the ink-jet printing method.

SUMMARY OF THE INVENTION

The present invention has the following constitutions to achieve the above-mentioned objects;

In the first aspect, the present invention resides in a method of ink-jet printing fabric composed of cellulose and synthetic fibers using reactive and disperse dyes, comprising treating the fabric with an acidic aqueous dispersion containing cellulose reactive compound, water-soluble polymer and non-water-soluble inactive organic compound with a melting point of 40° C.–150° C. and drying it before its ink-jet printing.

In the second aspect, the present invention resides in an ink-jet printing method as specified in the first aspect of the present invention, wherein said cellulose reactive compound is a nitrogen-containing organic compound.

In the third aspect, the present invention resides in an ink-jet printing method as specified in the first or second aspect of the present invention, wherein said cellulose reactive compound is an alicyclic or aromatic compound with one or two nitrogen atoms as its ring member.

In the fourth aspect, the present invention resides in an ink-jet printing method as specified in one of the first to third aspects of the present invention, wherein said cellulose reactive compound contains at least one compound selected from pyridine carboxylic acid and pyridine carboxylic acid amide compounds.

In the fifth aspect, the present invention resides in an ink-jet printing method as specified in one of the first to fourth aspects of the present invention, wherein said non-water-soluble inactive organic compound contains at least one compound selected from hydrocarbon wax, fatty acid amide and polyhydric alcohol fatty acid ester compounds.

In the sixth aspect, the present invention resides in an ink-jet printing method as specified in one of the first to fifth aspects of the present invention, wherein said synthetic fiber is polyester or acetate fiber.

In the seventh aspect, the present invention resides in ink-jet printed goods obtained by an ink-jet printing method as specified in one of the first to sixth aspects of the present invention.

DETAILED DESCRIPTION OF THE INVENTION

The present invention is more specifically illustrated hereinafter by using a polyester/cellulose blend as an example of the fabric covered by the present invention.

The reaction between a reactive dye and cellulose fiber is known to proceed by ionization of the cellulose fiber to Cell-O$^-$ (cellulose ion) for its nucleophilic substitution reaction or nucleophilic addition reaction with the reactive dye.

The ionization of cellulose fiber in water to Cell-O$^-$ proceeds according to a rise in the pH of the water to such an extent that the concentration of the ion in it, which is $3\times10^{-6}$ when its pH is 7, increases by 1000 times to $3\times10^{-3}$ when its pH is raised to 10.

This increase in the ionization of cellulose fiber in water as a result of a rise in its pH is assumed to cause the rate of reaction between the fiber and a reactive dye in it to increase by 1,000 to 100,000 times, resulting in dyeing of cellulose fiber fabric with reactive dyes being generally carried out in the pH range of 9 to 12 under an alkaline condition.

However, dyeing of polyester fiber fabric with disperse dyes under the above pH range presents a problem of causing the fabric to be dyed with poor color reproducibility and levelness. (Polyester fiber fabric is generally dyed with disperse dyes in a pH range from acidic to neutral, which is suitable for allowing the dyeing to occur in a satisfactory manner.)

This suggests that printing fabric composed of polyester and cellulose fibers with satisfactory color shade depth and brilliancy by an ink-jet system requires the cellulose fiber to be activated in a pH range from acidic to neutral, increasing its ionization to cellulose ions for reaction with reactive dyes at a higher rate.

The cellulose reactive compound referred to in the present invention is effective in increasing the rate of reaction between reactive dyes and cellulose fiber even in a pH range from weakly acidic to neutral.

The mechanism by which the cellulose reactive compound of the present invention acts to bring such an effect as mentioned above is not yet to be established. However, there are two hypothetical mechanisms considered for the action of the cellulose reactive compound of the present invention on dyeing of cellulose fiber with a reactive dye. One is based on the reaction of the cellulose reactive compound with the cellulose fiber, which causes it to be activated with its ions or activated seats increased in number, allowing the reactive dye to form a covalent bond with it by nucleophilic substitution or addition reaction for its coloration.

The other is based on the reaction of the cellulose reactive compound with the reactive dye, which causes the former to be electrically charged with positive ions, thereby increasing the substantivity of the reactive dye to the cellulose fiber electrically charged with negative ions.

Therefore, the use of the cellulose reactive compound of the present invention in printing of fabric composed of cellulose and polyester fibers with reactive and disperse dyes by an ink-jet system according to the present invention is assumed to allow it to act according to the above-mentioned two synergetic mechanisms, increasing the rate of reaction between the reactive dye and cellulose fiber even in a pH range from weakly acidic to neutral without adversely affecting the dyeing of the polyester fiber with the disperse dye so as to enable the fabric to be dyed with satisfactory color uniformity and reproducibility.

According to the present invention, fabric is required to be treated with an acidic aqueous dispersion containing cellulose reactive compound, water-soluble polymer and non-water-soluble inactive organic compound with a melting point of 40° C.–150° C. (hereinafter referred to as the "pretreatment solution") before being subjected to ink-jet printing.

The water-soluble polymer useful in the present invention is a polymer that can function as an ink holding agent. Such polymers include, without limitation, carboxymethylcellulose, sodium alginate, guar gum, locust bean gum, gum Arabic, crystal gum, methylcellulose, polyacrylamide, starch, sodium polyacrylate, sodium polystyrene sulfonate, hydroxyethylcellulose, polyvinyl alcohol and other water-soluble polymers known as ink holding agents.

Among these polymers, carboxymethylcellulose or sodium alginate with a high degree of substitution, or a mixture of both is particularly preferable for the present invention in that they are effective in allowing fabric to be printed with high color shade depth, fastness and brilliancy.

According to the present invention, the pretreatment solution normally contains such a water-soluble polymer at a concentration of 0.3 to 10.0% by weight.

The cellulose reactive compound useful in the present invention, as mentioned above, refers to a chemical compound that functions to accelerate the reaction between a reactive dye and cellulose fiber. Such chemical compounds include, without limitation, pyridine based-, pyrazine based-, quinoline based-, piperidine based-, piperazine based- and other alicyclic or aromatic compounds, each having one or two nitrogen atoms as its ring member, and amino acid based compounds.

The preferred pyridine based compounds include pyridine carboxylic acid compounds such as picolinic acid, nicotinic acid, isonicotinic acid, dinicotinic acid and dipicolinic acid, pyridine carboxylic acid amide compounds such as nicotinic acid amide and picolinic acid amide, methyl pyridine compounds such as pyridine methanol, α-picoline and β-picoline, and aminopyridine compounds such as pyridyl amine and dimethyl pyridine amine.

The preferred pyrazine based compounds include pyrazine carboxylic acid compounds such as pyrazine monocarboxylic acid, pyrazine dicarboxylic acid and carbamoylpyrazine carboxylic acid, and methyl pyrazine compounds such as dimethyl pyrazine and methyl pyrazine.

The preferred quinoline based compounds include methyl quinoline compounds such as hydroxyquinaldine, methyl carbostyryl and quinaldine, and quinoline carboxylic acid compounds such as quinaldinic acid, kynurenic acid and quininic acid.

The preferred piperidine based compounds include methyl piperidine compounds such as 2-pipecoline, 3-pipecoline and 4-pipecoline, and piperidine carboxylic acid compounds such as pipecolinic acid, nipecotic acid and isonipecotic acid.

The preferred piperazine based compounds include dimethyl piperazine, pyrimidyl piperazine, 2-methyl piperazine and aminomethyl piperazine.

The preferred amino acid based compounds include L-alanine, glycine, glutamine and L-proline.

Among these compounds, pyridine based compounds, especially pyridine carboxylic acid and pyridine carboxylic acid amide compounds, are more preferred for the present invention as they are highly effective in accelerating the reaction between reactive dyes and cellulose fiber.

According to the present invention, the pretreatment solution preferably contains the cellulose reactive compound at a concentration of 0.3% to 5.0% by weight.

In the present invention the above-mentioned cellulose reactive compound is used together with a non-water-soluble inactive organic compound as ingredients of the pretreatment solution to be applied to fabric composed of cellulose and polyester fibers before ink-jet printing of the fabric in order to allow it to be ink-jet printed with satisfactory color shade depth and brilliancy.

The reason for the above is as follows; ink-jet printing on cellulose fiber, which is hydrophilic, and polyester fiber, which is hydrophobic, at the same time results in differences between both fibers in their absorption, penetration and other processing of the ink applied to them, causing a problem of their being ink-jet printed with poor color uniformity and levelness.

According to the present invention, the application of the pretreatment solution containing a non-water-soluble inactive organic compound to fabric composed of cellulose and polyester fibers before its ink-jet printing allows the non-water soluble inactive organic compound to act not only alone, but also in interaction with the other components of the pretreatment solution as defined herein earlier, to smoothen its surface, while making the surface of both cellulose and polyester fibers hydrophobic, thereby enabling the ink to be applied to it uniformly.

The non-water-soluble inactive compound of the present invention also functions to prevent the water component of the ink applied to the fabric from penetrating into its inside, staying on the surface of the ink accepting layer formed on the fabric.

The above-described action of the non-water-soluble inactive organic compound of the present invention allows fabric treated with the pretreatment solution containing it according to the present invention to be ink-jet printed with high color shade depth and little ink bleeding from the printed design patterns on the fabric.

The non-water-soluble inactive organic compound referred to in the present invention is an organic monomer, oligomer or low molecular weight polymer with a melting point of 40° C. to 150° C., the number average molecular weight of which is normally 10,000 or below, preferably 5,000 or below, more preferably ranging between 100 and 2,000.

Any non-water-soluble inactive organic compound, the number average molecular weight is above 10,000, is unsuitable for the present invention because it is not only high in its melting point, but also it is difficult to emulsify and disperse in water for use as an ingredient of the pretreatment solution.

Any organic monomer, oligomer or low molecular weight polymer with a melting point of less than 40° C. presents a problem with use as a non-water-soluble inactive organic compound of the present invention because it is unstable both in application and storage. Conversely, a similar compound with a melting point above 150° C. requires the fabric treated with the pretreatment solution containing the compound to be heat-treated at a high temperature for its melting, possibly causing the fabric to undergo not only problems such as yellowing and degradation, but also damage to its texture.

Among the non-water-soluble inactive organic compounds useful in the present invention are low molecular weight synthetic resin, hydrocarbon wax, natural wax, higher fatty acid amide, higher alcohol and polyhydric alcohol higher fatty acid ester compounds. More specifically, the preferred non-water-soluble low molecular weight synthetic resin compounds include low molecular weight nylon and polyvinyl chloride. The preferred hydrocarbon wax compounds include lower alkylene polymers such as polyethylene, paraffin wax and polyethylene wax, and petrochemical synthetic waxes such as microcrystalline wax, petrolatum and Fischer-Tropsch wax. The preferred natural wax compounds include vegetable waxes such as carnauba wax, candelilla wax, rice wax and Japan tollow wax, and mineral waxes such as montan wax, ozokerite and ceresin. The preferred higher fatty acid amid compounds include ethylene bis-stearic acid amide, stearic acid amide, oleic acid amide, methylol stearic acid amide and 12-hydroxystearic acid amide. The preferred higher alcohol compounds include ethoxylcetyl alcohol and ethoxylstearyl alcohol. The preferred polyhydric alcohol higher fatty acid ester compounds include glycerin oleate, glycerine stearate, propylene glycol stearate, ethylene glycol stearate and 12-hydroxystearate. Among these compounds, hydrocarbon wax, higher fatty acid amide and polyhydric alcohol higher fatty acid ester compounds are more preferred, among which a mixture of hydrocarbon wax and compound selected from the rest is most preferred because it is excellent in emulsifiability and dispersibility in water for use as an ingredient of the pretreatment solution according to the present invention.

The pretreatment solution of the present invention preferably contains the non-water-soluble inactive organic compound at a concentration of 0.5 to 20.0% by weight. The application of the pretreatment solution containing said non-water-soluble inactive organic compound at a concentration below 0.5% by weight to fabric according to the present invention results in failure to prevent the ink thereafter applied to the fabric from penetrating into its inside, causing it to be printed with poor color shade depth. Conversely, the use of said non-water-soluble inactive organic compound in the pretreatment solution at a concentration above 20% by weight for application to fabric according to the present invention not only results in failure to improve its effect referred to herein to a great extent for its concentration, but also has an adverse effect on the fabric's absorption of the ink thereafter applied to it, causing it to be printed with poor color levelness and pattern outline sharpness. According to the present invention, the pretreatment solution containing the above-mentioned three types of compounds is adjusted to be acidic so that its pH preferably ranges from 4.5 to 6.5.

Fabric useful in the present invention from a constructional point of view includes fabric of various constructions such as woven, knitted, non-woven and braided, among which woven and knitted fabric is particularly preferable for the present invention.

The material composing the fabric that is useful in the present invention as its synthetic fiber component includes various types of polyester fibers such as polyethylene terephthalate and polybutylene terephthalate, acetate fibers such as diacetate and triacetate, and polyamide fibers such as nylon 6 and nylon 66. It should be noted here that acetate fibers, which are generally categorized as semi-synthetic fibers, are included in synthetic fibers as herein defined for the purpose of the present invention. Among these fibers, polyester or acetate fiber, which is dyeable in a pH range from neutral to weakly acidic, is preferable for the present invention.

The material composing the fabric that is useful in the present invention as its cellulose fiber component includes natural fibers such as cotton and hemp, and regenerated fibers such as rayon and cupra.

The fabric useful in the present invention is not subject to specific limitation in its synthetic/cellulose fiber ratio, which normally ranges between 95/5 and 5/95 by weight for the present invention.

The pretreatment solution to be applied to fabric before its ink-jet printing according to the present invention may contain one or more of flame retardants, ultraviolet absorbers, anti-reductants, anti-oxidants, pH controllers, hydrotropes, antifoamers, penetrants, micropore forming agents and other chemicals if necessary to facilitate its application to the fabric and/or improve the quality of the resultant printed goods, but not to the extent inconsistent with the purpose of the present invention.

The preferred flame retardants include halogenated compounds such as hexabromocyclododecane, tetrabromobisphenol, chlorinated paraffin and decabromodiphenyl ether, phosphorous compounds such as tricresyl phosphate, chlorophosphate and triethylphosphate, and inorganic compounds such as antimony trioxide, zinc oxide and boric acid.

The preferred ultraviolet absorbers include benzotriazole and benzophenone.

The preferred anti-reductants include nitrobenzenesulphonate and benzenesulphonic acid derivatives.

The preferred anti-oxidants include hindered amine and hindered phenol.

The preferred pH controllers include acidicity controllers such as malic acid, citric acid, acetic acid, ammonium sulfate, ammonium citrate and potassium dihydrogen phosphate, and alkalinity controllers such as sodium hydrogen carbonate, sodium carbonate, disodium hydrogen phosphate and sodium acetate.

The preferred hydrotropes include urea, polyethylene glycol and thiourea.

The preferred antifoamers include lower alcohols such as isopropanol, ethanol and n-butanol, organic polar compounds such as oleic acid and polypropylene glycol, and silicone resins.

The preferred penetrants include anionic surface active agents such as sodium dodecylbenzenesulphonate, sodium lauryl sulfate and butyl oleate, and nonionic surface active agents such as nonylphenol EO and lauryl alcohol EO.

The preferred micropore formers include water-insoluble or hardly water-soluble liquids with a low boiling point of 105 to 200° C. emulsified and dispersed homogeneously in water as fine particles. Among such liquids are hydrocarbons such as toluene and xylene, halogenated hydrocarbons such as perchloroethylene, monochlorobenzene and dichloropentane, and organic acids such as butyl acetate and butyl acrylic acid.

According to the present invention, the application of the pretreatment solution to fabric can be carried out by any type of method or system such as padding, spraying, dipping, coating, laminating, gravure and ink jet as long as the method or system allows the solution to be uniformly applied to the fabric with the temperature of the solution normally maintained at an ordinary temperature of 20° C. to 40° C.

According to the present invention, the application of the pretreatment solution to fabric is followed by a process of subjecting the fabric to heat treatment for its drying. The heat treatment of the fabric is preferably performed at a temperature equal to or more than the melting or softening point of the non-water-soluble inactive organic compound contained in the pretreatment solution applied to it. Notwithstanding this, however, the drying temperature for the fabric, if held below 80° C., causes a problem of its inefficient drying, while, if raised above 180° C., presenting a problem of the water-soluble polymer in the pretreatment solution applied to it being subjected to degradation and discoloration. The present prevention therefore recommends that the fabric should be practically dried in a temperature range of 80° C. to 180° C., preferably 100° C. to 150° C. The time during which to dry the fabric in the above-specified temperature range is also an important factor to be considered for practicing the presenting invention. The drying time for the fabric, if held to less than 0.5 minute, presents a problem of causing the compounds in the pretreatment solution applied to it to undergo variation in film formation and its insufficient drying, while, if extended for more than 60 minutes, causing a problem of the water-soluble polymer in the pretreatment solution applied to it being subjected to degradation and discoloration. The present invention therefore recommends that the fabric should be dried in the above-specified temperature range for a time period of 0.5 to 60 minutes, preferably 1 to 20 minutes.

According to the present invention, the above-described heat treatment of the fabric allows the non-water-soluble inactive organic compound deposited in it to be melted, covering all over its surface so as to make the surface of both cellulose and polyester fibers uniformly hydrophobic, thereby enabling it to be ink-jet printed with the ink applied all over its surface.

The ink referred to in the present invention for ink-jet printing on fabric is sufficiently useful for the purpose of the present invention if it contains reactive and disperse dyes, irrespective of whether it consists of two separate inks, one for reactive dye and the other for disperse dye, or a mixture of both. These dyes can be selected from conventional one. Examples include reactive dyes such as azo, metal-complex azo, anthraquinone, phthalocyanine, formazan and oxazin compounds, and disperse dyes such as azo, benzeneazo, disazo, anthraquinone, coumarin, quinoline and nitro compounds.

The method for ink-jet printing on fabric according to the present invention can be selected from various continuous systems such as charge modulating type, micro dotting type, electrostatic charge control type and ink mist type, and on-demand systems such as stemme type, pulse jet type, bubble jet type and electrostatic suction type.

The ink useful in the ink-jet printing of the present invention can contain one or more of dispersants, antifoamers, penetrants, pH controllers and other additives if necessary to facilitate its application to the fabric and/or improve the quality of the resultant printed goods, but not to the extent inconsistent with the purpose of the present invention.

According to the present invention, the above-described process of ink-jet printing on fabric is normally followed by a process of subjecting the fabric to wet heat treatment, which is to be normally performed at 150 to 190° C. for 0.5 to 60 minutes, preferably at 160 to 180° C. for 5 to 30 minutes.

The temperature for the wet heat treatment of the fabric, if held below 150° C., causes a problem of the dyes deposited in it suffering poor color development, while, if set above 190° C., presenting a problem of its texture and the water-soluble polymer deposited in it becoming yellowed, or the resin deposited in it becoming hardened. The time for the wet heat treatment of the fabric in the above-specified temperature range, if held to less than 0.5 minute, presents a problem of the dyes deposited in it undergoing variation in color development, while, if extended for more than 60 minutes, causing a problem of the water-soluble polymer deposited in it being subjected to discoloration and degradation.

The fabric subjected to the pretreatment, ink-jet printing and wet heat treatment as described above according to the present invention is finally soaped and dried for finishing it into final printed goods referred to in the present invention as one of its objects.

EXAMPLES

The following examples, not to be construed to limit the scope of the present invention, serve to illustrate its certain embodiments and aspects, providing the results of the evaluation made on the resultant printed goods for the following three items—color shade depth, color brilliancy and color uniformity—in comparison with those obtained for comparative examples in order to confirm the effectiveness of the present invention.

The methods used for the evaluation of these three items are as follows:

(1) Color Shade depth

The color shade depth of the ink-jet printed goods was evaluated by measuring their blue ink solid-printed portions with a reflection density meter (Macbeth RD918), which yields a larger value if their shade depth is higher.

(2) Color Brilliancy

The color brilliancy of the ink-jet printed goods was evaluated by visual observation according to the following three-grade scale:

○: Good

Δ: Fair x: Poor (3) Color Uniformity

The color uniformity of the ink-jet printed goods was evaluated by visual comparison of their cellulose and polyester fibers for color consistency.

○: Good

Δ: Fair x: Poor

Example 1

Plain weave fabric composed of polyester 50% and cotton 50% was padded with a pretreatment solution prepared according to the following recipe.

| ① Pretreatment solution (pH 5.2) | |
|---|---|
| CELLOGEN PR (Dai-Ichi Kogyo Seiyaku-made water-soluble polymer based on carboxymethylcellulose) | 2 parts |
| Isonicotic acid | 1 part |
| LIPO-OIL NT-15 (Nicca Chemical-made non-water-soluble inactive organic compound based on a mixture of polyhydric alcohol higher fatty acid ester and hydrocarbon wax with a melting point of 60° C.) | 3 parts |
| pH controller: Disodium hydrogen phosphate | 1 part |
| Urea | 3 parts |
| Water | 90 parts |

The pretreated fabric was then dried at 130° C. for two minutes before being ink-jet printed with the ink prepared according to the following recipe using an on-demand type serial scanning ink-jet printer under the ink-jet printing condition specified below to print a full-color image onto it.

| ② Ink recipe<br>Disperse dye ink | |
|---|---|
| Disperse dye | 5 parts |
| Lignin sulfonate (anionic surface active agent) | 4 parts |
| SHIN-ETSU SILICONE KM-70 (Shin-Etsu Chemical-made antifoamer) | 0.05 part |
| Ethylene glycol | 10 parts |
| Silicic acid | 0.1 part |
| Ion exchanged water | 80 parts |

The disperse dye was based on C.I. Disperse Yellow 149, C.I. Disperse Red 92 and C.I. Disperse Blue 54.

| Reactive dye ink | |
|---|---|
| Reactive dye | 10 parts |
| Ion exchanged water | 90 parts |

The reactive dye was based on C.I. Reactive Yellow 85, C.I. Reactive Red 24 and C.I. Reactive Blue 176.

| ③ Ink-jet printing condition | |
|---|---|
| Nozzle diameter | 40 μm |
| Drive voltage | 100 V |
| Frequency | 5 KHz |
| Resolution | 360 dpi (4 × 4 matrix) |

The ink-jet printed fabric was then subjected to wet heat treatment under superheated steam at 175° C. for seven minutes, followed by soaping and drying to finish it into final printed goods. The printed goods were evaluated for the three items. The results of the evaluation are shown in Table 1.

Example 2

Plain weave fabric composed of polyester 30% and rayon 70% was padded with a pretreatment solution prepared according to the following recipe.

| ① Pretreatment solution (pH 5.8) | | |
|---|---|---|
| PVA205 (Kuraray-made water-soluble polymer based on polyvinyl alcohol) | | 2 parts |
| Picolinic acid amide | | 1 part |
| LIPO-OIL NT-6 (Nicca Chemical-made non-water-soluble inactive organic compound based on polyhydric alcohol higher fatty acid ester with a melting point of 70° C.) | | 5 parts |
| pH controller: | Disodium hydrogen phosphate | 1 part |
| | Potassium dihydrogen phosphate | 1 part |
| Urea | | 3 parts |
| Water | | 88 parts |

The pretreated fabric was then subjected to drying, ink-jet printing and wet heat treatment, all being carried out under the same conditions as specified in Example 1 to print a full color image on it before soaping and drying it to finish it into final printed goods. The printed goods were evaluated for the three items. The results of the evaluation are shown in Table 1.

Example 3

Plain weave fabric composed of polyester 70% and cotton 30% was coated with a pretreatment solution prepared according to the following recipe.

| | | |
|---|---|---|
| ① Pretreatment solution (pH 5.6) | | |
| DUCKALGIN NSPL | | 3 parts |
| (Kibun Food Chemifa-made water-soluble polymer based on sodium alginate) | | |
| Picolinic acid | | 1 part |
| EMUSTAR-0413 | | 3 parts |
| (Nippon Seiro-made non-water-soluble inactive organic compound based on vegetable wax with a melting point of 80° C.) | | |
| pH controller: | Disodium hydrogen phosphate | 1 part |
| | Potassium dihydrogen phosphate | 1 part |
| Urea | | 3 parts |
| Micropore former(*) | | 15 parts |
| (*) Mineral turpentine 50% | | |
| Aroemulphor HD 2% | | |
| (Meisei Chemical-made emulsifier) | | |
| Water 48% | | |
| Water | | 73 parts |

The pretreated fabric was then subjected to drying, ink-jet printing and wet heat treatment, all being carried out under the same conditions as specified in Example 1 to print a full color image on it before soaping and drying it to finish it into final printed goods. The printed goods were evaluated for the three items. The results of the evaluation are shown in Table 1.

Comparative Example 1

The same plain weave fabric as used in Example 1 was padded with a pretreatment solution prepared according to the following recipe.

| | | |
|---|---|---|
| Pretreatment solution (pH 8.2) | | |
| CELLOGEN PR | | 2 parts |
| (Dai-Ichi Kogyo Seiyaku-made water-soluble polymer based on carboxymethylcellulose) | | |
| pH controller: Sodium hydrogen carbonate | | 1 part |
| Urea | | 3 parts |
| Water | | 94 parts |

The pretreated fabric was then subjected to drying, ink-jet printing and wet heat treatment, all being carried out under the same conditions as specified in Example 1 to print a full color image on it before soaping and drying it to finish it into final printed goods. The printed goods were evaluated for the three items. The results of the evaluation are shown in Table 1.

Comparative Example 2

The same plain weave fabric as used in Example 1 was padded with a pretreatment solution prepared according to the following recipe.

| | | |
|---|---|---|
| Pretreatment solution (pH 5.8) | | |
| CELLOGEN PR | | 2 parts |
| (Dai-Ichi Kogyo Seiyaku-made water-soluble polymer based on carboxymethylcellulose) | | |
| Picolinic acid amide | | 1 part |
| pH controller: | Disodium hydrogen phosphate | 1 part |
| | Potassium dihydrogen phosphate | 1 part |
| Urea | | 3 parts |
| Water | | 92 parts |

The pretreated fabric was then subjected to drying, ink-jet printing and wet heat treatment, all being carried out under the same conditions as specified in Example 1 to print a full color image on it before soaping and drying it to finish it into final printed goods. The printed goods were evaluated for the three items. The results of the evaluation are shown in Table 1.

Comparative Example 3

The same plain weave fabric as used in Example 1 was padded with a pretreatment solution prepared according to the following recipe.

| | | |
|---|---|---|
| Pretreatment solution (pH 7.3) | | |
| CELLOGEN PR | | 2 parts |
| (Dai-Ichi Kogyo Seiyaku-made water-soluble polymer based on carboxymethylcellulose) | | |
| LIPO-OIL NT-15 | | 3 parts |
| (Nicca Chemical-made non-water-soluble inactive organic compound based on a mixture of polyhydric alcohol higher fatty acid ester and hydrocarbon wax with a melting point of 60° C.) | | |
| pH controller: Disodium hydrogen phosphate | | 1 part |
| Urea | | 3 parts |
| Water | | 91 parts |

The pretreated fabric was then subjected to drying, ink-jet printing and wet heat treatment, all being carried out under the same conditions as specified in Example 1 to print a full color image on it before soaping and drying it to finish it into final printed goods. The printed goods were evaluated for the three items. The results of the evaluation are shown in Table 1.

TABLE 1

| | Color shade depth | Color brilliancy | Color uniformity |
|---|---|---|---|
| Example 1 | 1.54 | ○ | ○ |
| Example 2 | 1.49 | ○ | Δ-○ |
| Example 3 | 1.51 | Δ-○ | ○ |
| Comparative Example 1 | 1.15 | X-Δ | X |
| Comparative Example 2 | 1.32 | X | Δ-○ |
| Comparative Example 3 | 1.23 | Δ | X |

EFFECTS OF THE INVENTION

The printed goods obtained according to the present invention have proved to be excellent in quality with high color shade depth, as well as good color brilliancy and uniformity. Accordingly, the present invention has allowed ink-jet printing to be applied to even fabric composed of synthetic and cellulose fibers, finishing the fabric into extremely high quality printed goods.

What is claimed is:

1. A method of ink-jet printing fabric composed of natural or regenerated cellulose and synthetic or semi-synthetic fibers using reactive and disperse dyes, comprising treating the fabric with an acidic aqueous dispersion containing a cellulose reactive compound selected from the group consisting of pyridine based compounds, pyrazine based compounds, quinoline based compounds, piperdine based compounds, piperazine based compounds and amino acid based compounds, water soluble polymer and a non-water soluble inactive organic compound with a melting point of 40° C.–150° C. and selected from the group consisting of low molecular weight synthetic resin, hydrocarbon wax, natural wax, higher fatty acid amide, higher alcohol and polyhyric alcohol higher fatty acid ester compounds and drying it before its ink-jet printing.

2. An ink-jet printing method as claimed in claim 1, wherein said cellulose reactive compound contains at least one compound selected from pyridine carboxylic acid and pyridine carboxylic acid amide compounds.

3. An ink-jet printing method as claimed in claim 1, wherein said non-water-soluble inactive organic compound is selected from the group consisting of hydrocarbon wax, fatty acid amide and polyhydric alcohol fatty acid ester compounds or mixtures thereof.

4. An ink-jet printing method as claimed in claim 1, wherein said synthetic or semi-synthetic fiber is polyester or acetate fiber.

* * * * *